United States Patent [19]

Oleck et al.

[11] Patent Number: 4,508,615

[45] Date of Patent: Apr. 2, 1985

[54] MULTI-STAGE PROCESS FOR DEMETALATION, DESULFURIZATION AND DEWAXING OF PETROLEUM OILS

[75] Inventors: Stephen M. Oleck, Moorestown; Robert C. Wilson, Jr., Woodbury, both of N.J.

[73] Assignee: Mobil Oil Corporation, New York, N.Y.

[21] Appl. No.: 580,578

[22] Filed: Feb. 16, 1984

[51] Int. Cl.[3] ..... C10G 65/02; C10G 45/64

[52] U.S. Cl. ..... 208/89; 208/210; 208/216 PP; 208/251 H

[58] Field of Search ..... 208/89, 251 H, 210, 208/216 PP

[56] References Cited

U.S. PATENT DOCUMENTS

| | | | |
|---|---|---|---|
| 3,835,027 | 9/1974 | Ward | 208/111 |
| 3,923,638 | 12/1975 | Bertolacini et al. | 208/89 |
| 4,089,774 | 5/1978 | Oleck et al. | 208/89 |
| 4,177,163 | 12/1979 | Oleck et al. | 208/216 PP |
| 4,267,033 | 5/1981 | Heck et al. | 208/216 PP |
| 4,313,817 | 2/1982 | Mayer et al. | 208/89 |
| 4,394,249 | 7/1983 | Shen | 208/89 |
| 4,440,630 | 4/1984 | Oleck et al. | 208/111 |

*Primary Examiner*—Delbert E. Gantz
*Assistant Examiner*—O. Chaudhuri
*Attorney, Agent, or Firm*—Alexander J. McKillop; Michael G. Gilman; Van D. Harrison, Jr.

[57] ABSTRACT

A catalytic multi-stage hydrocarbon conversion process is provided for reducing high metals content, sulfur content and pour point of the catalytically reacted residual oil by the use of sequential combination of catalytic compositions. In the first stage, the residual oil, under demetalation and desulfurization reaction conditions, is passed over a catalyst comprising about 1 to about 10 weight percent of a Group VIB metal, based on the total catalyst weight, on a supporting comprising at least 85 weight percent alumina. The resulting catalyst contains at least 65 percent of its pore volume in the 150 to 300 Angstroms diameter range or at least 60 percent of its pore volume in the 100 to 200 Angstroms diameter range. The resulting product of stage 1, under desulfurization and dewaxing conditions, is then passed over a second catalyst comprising about 1 to about 10 percent of an iron group metal and about 5 to about 25 weight percent of a Group VIB metal, based on the total catalyst weight, on a support comprising a composite of alumina and a minor amount of about 5 to about 25 weight percent of a ZSM-5 crystalline zeolite based on the total composite. The resulting catalyst contains at least 60 percent of its pore volume in the 50 to 200 Angstroms diameter range or at least 50% of its pore volume in the 30 to 100 Angstroms diameter range.

12 Claims, No Drawings

MULTI-STAGE PROCESS FOR DEMETALATION, DESULFURIZATION AND DEWAXING OF PETROLEUM OILS

BACKGROUND OF THE INVENTION

1. Field of the Invention

This invention relates to a catalytic hydrocarbon conversion process for the demetalation, desulfurization and dewaxing of residual oils. More particularly, the invention relates to a catalytic multi-stage hydrocarbon conversion process for reducing high metals content, sulfur content and pour point of the catalytically-reacted residual oil by the use of a sequential combination of catalytic compositions which have been found to be especially effective for this purpose.

2. Description of the Prior Art

Residual petroleum oil fractions produced by atmospheric or vacuum distillation of crude petroleum are characterized by relatively high metals, high sulfur, high Conradson Carbon Residue (CCR) and high amounts of paraffinic wax-producing components. This comes about because practically all of the metals and CCR present remain in residual fraction and a disproportionate amount of sulfur and paraffinic wax-producing components in the original crude oil also remains in that fraction. Principal metal contaminants are nickel and vanadium, with iron and small amounts of copper also sometimes present. Additionally, trace amounts of zinc and sodium are found in some feedstocks. The high metals and CCR content of the residual fractions generally preclude their effective use as charge stocks for subsequent catalyst processing such as catalytic cracking and hydrocracking. The metal contaminants deposit on the special catalysts for these cracking processes and cause the premature aging of the catalyst and/or formation of inordinate amounts of coke, dry gas and hydrogen. CCR, a measure of a molecule's tendency to coke rather than crack and/or distill, is also an undesirable property for charge streams processed by catalytic cracking. Under the high temperature employed in catalytic cracking, molecules high in CCR thermally and/or catalytically degrade to coke, light gases, and hydrogen.

It is current practice to upgrade certain residual fractions by a pyrolytic operation known as coking. In this operation the residuum is destructively distilled to produce distillates of low metals content and leaves behind a solid coke fraction that contains most of the metals. Coking is typically carried out in a reactor or drum operated at about 800° to 1100° F. temperature and a pressure of one to ten atmospheres. The economic value of the coke by-product is determined by its quality, especially its sulfur and metals content. Excessively high levels of these contaminants make the coke useful only as low valued fuel. In contrast, cokes of low metals content, for example up to about 100 ppm (parts-per-million by weight) of nickel and vanadium, and containing less than about 2 weight percent sulfur may be used in high valued metallurgical, electrical and mechanical applications.

Certain residual fractions are currently subjected to visbreaking, which is a heat treatment of milder conditions than used in coking, in order to reduce their viscosity and make them more suitable as fuels. Again, excessive sulfur content sometimes limits the value of the product.

Residual fractions are sometimes used directly as fuels. For this use, a high sulfur content is in many cases, unacceptable for environmental reasons.

At present, catalytic cracking is generally done utilizing hydrocarbon charge stocks lighter than residual fractions which generally have an API gravity less than 20. Typical cracking charge stocks are coker and/or crude unit gas oils, vacuum tower overhead, etc., the feedstock having an API gravity from about 15 to about 45. Since these cracking charge stocks are distillates, they do not contain significant proportions of the large molecules in which the metals are concentrated. Such cracking is commonly carried out in a reactor operated at a temperature of about 800° to 1500° F., a pressure of about 1 to 5 atmospheres, and a space velocity of about 1 to 1000 WHSV.

The amount of metals present in a given hydrocarbon stream is often expressed as a charge stock's "metals factor". This factor is equal to the sum of the metals concentrations, in parts per million, of iron and vanadium plus ten times the concentration of nickel and copper in parts per million, and is expressed in equation form as follows:

$$Fm = Fe + V + 10(Ni + Cu)$$

Conventionally, a charge stock having a metals factor of 2.5 or less is considered particularly suitable for catalytic cracking. Nonetheless, streams with a metals factor of 2.5 to 25, or even 2.5 to 50, may be used to blend with or as all of the feedstock to a catalytic cracker, since charge stocks with metals factors greater than 2.5 in some circumstances may be used to advantage, for instance, with the new fluid cracking techniques.

In any case, the residual fractions of typical crudes will require treatment to reduce the metals factor. As an example, a typical Kuwait crude, considered of average metals constant, has a metals factor of about 75 to about 100. As almost all of the metals are combined with the residual fraction of a crude stock, it is clear than at least about 80% of the metals and preferably at least 90% needs to be removed to produce fractions (having a metals factor of about 2.5 to 50) suitable for cracking charge stocks.

Metals and sulfur contaminants would present similar problems with regard to hydrocracking operations which are typically carried out on charge stocks even lighter than those charged to a cracking unit. Typical hydrocracking reactor conditions consist of a temperature of 400° to 1000° F. and a pressure of 100 to 3500 psig.

It is evident that there is considerable need for an efficient method to reduce the metals and/or sulfur and/or CCR content of hydrocarbons, and particularly of residual petroleum fractions. While the technology to accomplish this for distillate fractions has been advanced considerably, attempts to apply this technology to residual fractions generally fail due to very rapid deactivation of the catalyst, presumably by metals contaminants and coke deposition.

U.S. Pat. No. 3,696,027 suggests sequentially contacting the feedstream with three fixed beds of catalysts having decreasing macroporosity along the normal direction of feed flow. "Macroporosity" denotes catalyst pores greater than about 500 Angstroms (A) in diameter. It is said to be strongly related to the capacity of catalyst particles to retain metals removed from a heavy hydrocarbon stream contaminated with organometallic compounds. The catalyst particles of the first bed of the '027 process have at least 30 vol.% macropores; the catalyst particles of the second bed have between 5 and 40 vol.% macropores; and the catalyst particles of the third bed have less than 5 vol.% macropores. The patent also teaches that the three fixed beds have progressively more active desulfurization catalysts along the normal direction of flow. The third catalyst bed (which contains the most active desulfurization catalyst) contains high surface area particles having an average pore diameter of at least 50 A, preferably at least 80 A, and more preferably at least 100 A, in order to lengthen the desulfurization run.

U.S. Pat. No. 3,730,879 discloses a two-bed catalytic process for the hydrodesulfurization of crude oil or a reduced fraction, in which at least 50% of the total pore volume of the first bed catalyst consists of pores in 100–200 A diameter range and in which less than 45% of the total pore volume of the second bed catalyst consists of pores in the 100–200 A diameter range. According to the '879 process, demetalation activity increases and desulfurization activity decreases along the normal direction of flow. The patent further suggests a two-catalyst-bed system with increasing average pore diameters and decreasing surface areas.

U.S. Pat. No. 3,766,058 also teaches a two-stage process for hydroprocessing a heavy hydrocarbon feedstock in which the second stage catalyst has a larger pore diameter than the first stage catalyst. Similar teachings are found in U.S. Pat. No. 3,830,720 and U.S. Pat. No. 4,048,060.

U.S. Pat. No. 3,876,530 discloses a multi-stage catalytic process for desulfurizing residual oils in which the initial stage catalyst has a relatively low proportion of hydrogenation metals and in which the final stage catalyst has a relatively high proportion of hydrogenation metals.

U.S. Pat. No. 3,931,052 suggests a two-stage process wherein the first stage catalyst has a strong selectivity for sulfur removal and the second stage catalyst has a strong selectivity for metals removeal (U.S. Pat. No. 3,931,052 at col. 4, lines 32–43). The active desulfurization catalyst has at least 50% of its pore volume in the 30 to 100 A diameter range. The active demetalation catalyst has pores substantially distributed over a narrow 180 to 300 A diameter range (not less than 65% of the total pore volume is contained in pores having a diameter between 180 to 300 A).

U.S. Pat. No. 3,977,962 discloses a two-stage hydroconversion process using catalysts having certain pore sizes, surface areas and pore volumes. Both stages employ high surface area catalysts (200–600 $m^2/g$). The second stage catalyst generally has a smaller average pore diameter and surface area relative to the first stage catalyst.

U.S. Pat. No. 4,016,067 discloses a process for demetalation and desulfurization of petroleum oils in two stages with sequentially decreasing average pore diameters and increasing surface areas. The first catalyst has at least about 60% of its pore volume in 100–200 A pores, at least about 5% of its pore volume in pores greater than 500 A, and a surface area of up to about 110 $m^2/g$. The second catalyst has at least 50% of its pore volume in 30 to 100 A pores and a surface area of at least 150 $m^2/g$.

U.S. Pat. No. 4,054,508 discloses a three-stage process for demetalation and desulfurization of petroleum oils wherein the first and second stages contain catalysts as described in related U.S. Pat. No. 4,016,067 (supra) and the third stage comprises a second, smaller bed of the first stage catalyst.

U.S. Pat. No. 4,306,964 describes a catalytic multistage process for removing metals, sulfur and CCR by contacting the oil sequentially with three of more catalysts having sequentially decreasing average pore diameters and sequentially increasing surface areas.

The processes in the above mentioned patents are satisfactory for the removal of metals, sulfur and CCR content from petroleum crude oils but a separate dewaxing is required to reduce the pour point of the resulting product. One approach to reduce the pour point of a petroleum crude oil is to isolate the desired lubricating stock from the crude oil by a set of subtractive unit operations which removes the unwanted components. The most important of these unit operations include distillation, solvent refining and dewaxing which are physical separation processes. Catalytic techniques are also available for dewaxing of petroleum stocks. A process of that nature developed by British Petroleum is described in The Oil and Gas Journal dated Jan. 6, 1975, at pages 69–73. See also U.S. Pat. No. 3,668,113.

In U.S. Pat. No. Re. 28,398 to Chen et al. is described a process for catalytic dewaxing with a catalyst comprising zeolite ZSM-5. Such a process combined with catalytic hydrofinishing is described in U.S. Pat. No. 3,894,938. U.S. Pat. No. 3,755,138 to Chen et al. describes a process for mild solvent dewaxing to remove high quality wax from a lube stock, which is then catalytically dewaxed to specification pour point. The entire contents of these patents are herein incorporated by reference.

U.S. Pat. No. 4,053,532 is directed towards a hydrodewaxing operation involving a Fischer-Tropsch synthesis product utilizing ZSM-5 zeolites.

U.S. Pat. No. 3,956,102 is connected with a process involving the hydrodewaxing of petroleum distillates utilizing a ZSM-5 zeolite catalyst.

U.S. Pat. No. 4,247,388 in the name of Banta et al. describes dewaxing operations utilizing ZSM-5 zeolites of specific activity.

U.S. Pat. No. 4,222,855 describes dewaxing operations to produce lubricating oils of low pour point and of high V.I. utilizing zeolites which includes ZSM-23 and ZSM-35.

U.S. Pat. No. 4,372,839 is directed to catalytically dewaxing a waxy distillate lubricating oil utilizing two different crystalline aluminosilicate zeolite catalysts of particularly defined characteristics.

In copending U.S. Application Mobile Docket 2670 entitled "Process for Dewaxing of Petroleum Oils Prior to Demetalation and Desulfurization," filed by the same inventors and commonly assigned as the instant invention, there is described a process for the reduction of metals, sulfur and wax-producing components in residual oils. In this multi-stage process, the preferred catalyst in the first (dewaxing) stage is a nickel-molybdenum on a composite of a minor amount of a ZSM-5 crystalline zeolite and alumina having small pores (i.e. at least 60 percent of its pore volume in the 50–200 Angstroms diameter range or at least 50% in the 30–100 Angstroms diameter range). The dewaxed residual oil is then subjected to demetalation and desulfurization by known prior art processes. Significant reductions of metals, sulfur and wax-producing components in the residual oil are achieved by using the dewaxing process upstream of the demetalation and desulfurization processes.

In the present invention, there is provided a multistage process which provides for demetalation, desulfurization and dewaxing of residual petroleum oils.

SUMMARY OF THE INVENTION

A process for demetalation, desulfurization and dewaxing of residual oil has been discovered using a two-stage process. In the first stage, the residual oil, under demetalation and desulfurization reaction conditions, is passed over a catalyst comprising about 1 to about 10 weight percent of an iron group metal and about 5 to about 25 weight percent of a Group VIB metal, based on the total catalyst weight, on a support comprising at least 85 weight percent alumina. The resulting catalyst contains at least 65 percent of its pore volume in the 150 to 300 Angstroms diameter range or at least 60 percent of its pore volume in the 100 to 200 Angstroms diameter range. The resulting product of stage 1, under desulfurization and dewaxing conditions, is then passed over a second catalyst comprising about 1 to about 10 percent of an iron group metal and about 5 to about 25 weight percent of a Group VIB metal, based on the total catalyst weight, on a support comprising a composite of alumina and a minor amount of about 5 to about 25 weight percent of a ZSM-5 crystalline zeolite based on the total composite. The resulting catalyst contains at least 60 percent of its pore volume in the 50 to 200 Angstroms diameter range or at least 50% of its pore volume in the 30 to 100 Angstroms diameter range.

DETAILED DESCRIPTION OF THE INVENTION

The hydrocarbon feed to the process of this invention can be a whole crude. However, since the high metal and sulfur components of a crude oil fuel to be concentrated in the higher boiling fractions, the present process more commonly will be applied to a bottoms fraction of a petroleum oil, i.e. one which is obtained by atmospheric distillation of a crude petroleum oil to remove lower boiling materials such as naphtha and furnace oil, or by vacuum distillation of an atmospheric residue to remove gas oil. Typical residues to which the present invention is applicable will normally be substantially composed of residual hydrocarbons boiling about 650° F. and containing a substantial quantity of asphaltic materials. Thus, the charge stock can be one having an initial or 5 percent boiling point somewhat below 650° F., provided that a substantial proportion, for example, about 70 or 80 percent by volume, of its hydrocarbon components boils above 650° F.

The process of this invention not only reduces the metal and sulfur content but also dewaxes the processed feed under the general reaction conditions described below for both steps of the process.

| | Broad Range | Preferred Range |
|---|---|---|
| Temperature, °F. | 500–1000 | 600–850 |
| Pressure, psig. | 300–3000 | 400–2500 |
| Space velocity, L.H.S.V. (Volume of resid oil per volume of catalyst per hour) | 0.1–5.0 | — |
| Hydrogen Recirculation Rate, S.C.F./bbl (standard cubic feet of hydrogen per bbl of oil feed) | 500–15,000 | 800–8000 |

These variables may be adjusted in known manner depending on the age of the catalysts and level of demetalation, desulfurization and dewaxing required. The catalyst in the first stage is primarily a demetalation catalyst although significant desulfurization also is achieved with it. The catalyst employed in the second stage provides both desulfurization and dewaxing functions.

The alumina support used in both catalysts can be naturally occurring alumina supports having the appropriate pore size diameter or the alumina support can be produced using an alpha-alumina monohydrate as the source of alumina. The monohydrate referred to is sometimes characterized as boehmite based on its X-ray diffraction pattern. A particularly useful boehmite is that known as "Captapal SB", which is a very pure form of alumina manufactured and sold by the Conoco Chemicals Div. of Continental Oil Company. Another suitable alumina of the boehmite variety known as "SA" alumina marketed by the Kaiser Chemical Company. Both Catapal SB and SA are characterized by about 25 weight percent loss on ignition, with generally a slightly higher content of sodium and silica impurities for the SA variety. The alumina can be extruded to form pellets. The alumina pellets can be precalcined to stabilize the support at temperatures from about 1000° F. to about 1700° F. for about 0.5 to about 10 hours or longer if desired. This support is used in the first stage of the process of this invention.

The support of the catalyst in the second stage is a blend of alumina and a ZSM-5 crystalline zeolite present in amounts from about 5 to about 25 weight percent, preferably about 10 to about 20 weight percent of the total support. The blends can be extruded to form pellets and the pellets can be precalcined.

The ZSM-5 crystalline zeolites are well known and described in detail in U.S. Pat. No. Re. 28,398 to Chen et al. which is incorporated by reference herein. These crystalline zeolites have pore sizes of about 5 Angstrom units and are preferably formed as an aluminosilicate. The zeolites used in the instant invention can have the original cations associated therewith replaced with a wide variety of other cations according to techniques well known in the art. Typical replacing cations would include hydrogen, ammonium and metal cations including mixtures of the same. Of the replacing metallic cations, particular preference is given to cations of metals such as rare earth metals, manganese, calcium, as well as metals of Group II of the Periodic Table, e.g. zinc and Group VIII of the Periodic Table, e.g. nickel. Typical ion exchange techniques would be to contact the particular zeolite with a salt of the desired replacing cation or cations. Although a wide variety of salts can be employed, particular reference is given to chlorides, nitrates and sulfates. Representative ion exchange techniques are disclosed in U.S. Pat. Nos. 3,140,249; 3,140,251; and 3,140,253.

The method of preparing the catalyst with the hereinabove described supports may follow standard practice. The iron group metal (i.e. iron, cobalt or nickel, especially cobalt or nickel with nickel preferred in the second stage catalyst and cobalt preferred in the first stage catalyst) and Group VIB metal (i.e. molybdenum, tungsten or chromium with molybdenum particularly preferred in the catalyst of both stages) may be added by impregnation of the precalcined support with suitable salt solutions, followed by drying, calcination and, if necessary, presulfiding. The final catalyst composition comprises about 1 to about 10 weight percent of an iron group metal and about 5 to about 25 weight percent of a Group VIB metal all computed on the basis of total catalyst weight and on an anhydrous basis. The iron group metal and the Group VIB metal may be present in the final catalyst as the oxides or sulfides of the metals.

The catalysts used in this invention have different pore sizes. It is desired for purposes of this invention to have smaller pore sizes in the catalyst of the second stage compared to the pores sizes of the catalyst in first stage. The pore size of the catalyst of the second stage may be described by either of two parameters, i.e. at least 60 percent of its pore volume in the 50 to 200 Angstroms diameter range or at least 50% of its pore volume in the 30 to 100 Angstroms diameter range. A catalyst meeting one but not necessarily both of these limitations may be employed in the second stage. The pore size of the catalyst of the first stage has at least 65 percent of its pore volume in the 150 to 300 Angstroms diameter range or at least 60% of its pore volume in the 100 to 200 Angstroms diameter range. As with the second stage catalyst a catalyst meeting, one but not necessarily both of these limitations may be employed in the first stage.

The preferred mode for operating the novel process of this invention is to use a fixed bed of catalysts either in a two bed arrangement or in sequential catalyst stages in one bed.

This invention is now illustrated by examples which are to be understood as not limiting on the scope of the invention, this scope being defined by the appended claims. All percentages refer to percentages by weight on an anhydrous basis unless specifically stated otherwise.

EXAMPLE 1

Preparation of First Stage Catalyst Support 1700 ml. of water were blended into 2500 grams of Kaiser SA alumina powder (26.0% L.O.I., 0.018 wt% $Na_2O$; 0.06wt% $SiO_2$). The mix was then auger extruded to 1/32 inch diameter cylinders and dried in an oven at 250° F. About 400 grams of the cylinders were then calcined for four hours at 1700° F. The product showed the following properties:

| | |
|---|---|
| Density, g/cc | |
| Packed | 0.53 |
| Particle | 0.96 |
| Real | 3.30 |
| Pore Volume, cc/g | 0.735 |
| Surface Area, $m^2/g$ | 116 |
| Avg. Pore Diameter, A | 253 |
| Pore Volume Distribution % in pores of | |
| 0–50 A Diameter | 10 |
| 50–100 | 6 |
| 100–150 | 19 |
| 150–200 | 46 |
| 200–300 | 12 |
| 300+ | 7 |

EXAMPLE 2

Preparation of First Stage Catalyst

Two hundred eighty grams of the support of Example 1 were impregnated to incipient wetness with 219 ml. of a solution containing 39.2 grams of ammonium heptamolybdate (81.5% $MoO_3$). They were dried at 250° F. and re-impregnated with 201 ml. of a solution containing 43.9 grams of cobalt nitrate hexahydrate. The thus impregnated cylinders were dried at 250° F. and calcined at 1000° F. for 10 hours.

The resulting catalyst contained 3.5 weight percent cobalt oxide and 10 weight percent molybdenum oxide.

The catalyst properties are as follows:

| | |
|---|---|
| Density g/cc | |
| Packed | 0.69 |
| Particle | 1.12 |
| Real | 3.59 |
| Pore Volume, cc/g | 0.613 |
| Surface Area, $m^2/g$ | 108 |
| Average Pore Diameter, Å | 227 |
| Pore Volume Distribution % in Pores Of | |
| 0–30 Å diameter | 5 |
| 30–50 | 2 |
| 50–80 | 1 |
| 80–100 | 2 |
| 100–150 | 13 |
| 150–200 | 27 |
| 200–300 | 41 |
| 300+ | 9 |

EXAMPLE 3

Preparation of Support of Second Stage Catalyst Support

A mixture comprising Kaiser SA alumina powder and dried ZSM-5 (15% NaZSM-5/85% $Al_2O_3$ on a dry basis) was blended with water and auger extruded into 1/32 inch diameter cylinders. These were dried and calcined at 1000° F., first in nitrogen and then in air. The calcined cylinders were exchanged with $NH_4NO_3$ solution to low sodium (0.01 wt%) and dried at 250° F. The solids content of the dried extrudate (1000° F. basis) was 86.4%.

EXAMPLE 4

Preparation of Second Stage Catalyst

Two hundred fifty grams of the support of Example 3 were impregnated to incipient wetness with 163 ml. of a solution containing 57.7 grams of ammonium heptamolybdate (81.5% $MoO_3$) and dried at 250° F. The product was impregnated with 133 ml. of a solution containing 44.0 grams nickel chloride hexahydrate, dried at 250° F. and calcined at 1000° F. for 10 hours.

The catalyst has the following properties:

| | |
|---|---|
| HZSM-5 content % | 15 |
| Metals Content, wt % | |
| NiO | 5 |
| $MoO_3$ | 17 |
| Density, g/cc | |
| Packed | 0.67 |
| Particle | 1.14 |
| Real | 3.49 |
| Pore Volume, cc/g | 0.590 |
| Surface Area, $m^2/g$ | 199 |
| Average Pore Diameter, Å | 119 |

-continued

| Pore Volume Distribution % in Pores Of | |
|---|---|
| 0–30 Å Diameter | 14 |
| 30–50 | 3 |
| 50–80 | 13 |
| 80–100 | 8 |
| 100–150 | 27 |
| 150–200 | 31 |
| 200–300 | 2 |
| 300+ | 2 |

EXAMPLE 5

Preparation of Second Stage Catalyst (Containing No Zeolite)

1700 ml. of water were blended into 2500 grams of Kaiser SA alumina powder (26.0% L.O.I.; 0.018 wt% $Na_2O$; 0.06wt% $SiO_2$). The mix was then auger extruded to 1/32 inch diameter cylinders and dried in an oven at 250° F. About 100 grams of the cylinders were then calcined at 1000° F. for 3 hours.

Fifty grams of the product were impregnated to incipient wetness with 41 ml. of a solution containing 13.4 grams ammonium hepatmolybdate (81.5% $MoO_3$) and dried at 250° F. The product was then impregnated with 35 ml. of a solution containing 10.2 grams nickel nitrate hexahydrate, dried at 250° F. and calcined at 1000° F. for 10 hours. The catalyst properties were as follows:

| Metals Content, wt % | |
|---|---|
| NiO | 5 |
| $MoO_3$ | 17 |
| Density, g/cc | |
| Packed | 0.67 |
| Particle | 1.19 |
| Real | 3.62 |
| Pore Volume, cc/g | 0.566 |
| Surface Area, $m^2$/go | 183 |
| Avg. Pore Diameter, Å | 124 |
| Pore Volume Distribution % in Pores of | |
| 0.30 Å Diameter | 5 |
| 30–50 | 8 |
| 50–80 | 17 |
| 80–100 | 9 |
| 100–150 | 28 |
| 150–200 | 25 |
| 200–300 | 3 |
| 300+ | 5 |

EXAMPLE 6

In the presence of the catalyst of Example 2 (a cobalt-molybdenum on a large pore alumina) Lagomedio atmospheric residuum was hydroprocessed in a batch, one-liter bomb reactor at 2000 psig., at 750° F., for 80 minutes and a 10/1 oil-to-catalyst weight ratio. The charge and product had the following properties:

| Properties | Charge | Product |
|---|---|---|
| Vanadium, ppm | 220 | 49 |
| Sulfur, wt % | 1.99 | 1.03 |
| CCR, wt % | 7.9 | 5.9 |
| Pour Point, °F. | 75 | 85 |

EXAMPLE 7

A portion of the product of Example 6 was charged to a batch, one-liter bomb reactor and hydrotreated at 2000 psig., at 750° F. for 80 minutes and a 20/1 oil-to-catalyst weight ratio using the catalyst of Example 4 (a nickel-molybdenum on a composite of small pore alumina support and 15 weight percent HZSM-5 crystalline aluminosilicate zeolite).

The product had the following properties:

| Product Properties | |
|---|---|
| Vanadium, ppm | 30 |
| Sulfur, wt % | 0.58 |
| CCR, wt % | 4.6 |
| Pour Point, °F. | 30 |

Comparing the product obtained here with the product feed and the original charge as described in Example 6, the vanadium, sulfur, Conradson Carbon Residue (CCR) contents and pour point of the product were significantly reduced over the original charge shown in Example 6.

EXAMPLE 8

A portion of the product of Example 6 was charged to a batch, one-liter bomb reactor and hydrotreated at 2000 psig at 750° F. for 80 minutes and a 20/1 oil-to-catalyst weight ratio using the catalyst of Example 5 (a nickel-molybdenum on alumina without a ZSM-5 zeolite).

The product had the following properties:

| Product Properties | |
|---|---|
| Vanadium, ppm | 29 |
| sulfur, wt % | 0.59 |
| CCR, wt % | 4.4 |
| Pour Point, °F. | 75 |

The results of Examples 7 and 8 demonstrate that the two stage process employing either the Example 4 or Example 5 second stage catalyst produces very similar products in regard to sulfur, vanadium and CCR levels. However, the product pour point was much lower with the second stage catalyst which contained the ZSM-5 zeolite, indicating substantial dewaxing with that particular system.

The subject process which combines demetalation-desulfurization-dewaxing functions, reduces the metal content to a low level in the first stage providing a suitable feed for the subsequent simultaneous desulfurization-dewaxing in the second stage.

What is claimed is:

1. A multi-stage process for demetalation, desulfurization and dewaxing of residual oil which comprises:

(1) contacting a residual oil under demetalation and desulfurization reaction conditions at a temperature of about 500° to about 1000° F., and a pressure of about 300 to about 3000 psig, with a catalyst comprising about 1 to about 10 weight percent of an iron group metal and about 5 to about 25 weight percent of a Group VIB metal, said metals based on the total catalyst, and being present as the oxides or sulfides, on a support comprising at least 85 weight percent alumina, said catalyst having at least 65 percent of its pore volume in the 150 to 300 Angstroms diameter range or at least 60 percent of its pore volume in the 100–200 Angstroms diameter range, (2) contacting the product of step (1), under desulfurization and dewaxing reaction conditions at a temperature of about 500° to about 1000° F., and a pressure of about 300 to about 3000 psig, with a catalyst comprising about 1 to about 10 weight percent of an iron group metal and about 5 to about 25 weight percent of a Group VIB metal, said metals based on the total catalyst, and being present as the oxides or sulfides on a support comprising a composite of alumina and about 5 to about 25 weight percent of a ZSM-5 crystalline zeolite based on the total composite, said catalyst having at least 60 percent of its pore volume in the 50 to 200 Angstroms diameter range.

2. The process of claim 1 wherein said iron group metal of the catalyst used in step (1) is cobalt.

3. The process of claim 1 wherein the Group VIB metal of the catalyst used in step (1) is molybdenum.

4. The process of claim 1 wherein said iron group of the catalyst used in step (2) is nickel.

5. The process of claim 1 wherein the Group VIB metal of the catalyst used in step (2) is molybdenum.

6. The process of claim 1 wherein the ZSM-5 crystalline zeolite in the catalyst of step (2) is present in amounts from about 10 to about 20 weight percent based on the total composite.

7. The process of claim 6 wherein the ZSM-5 crystalline zeolite is HZSM-5 crystalline aluminosilicate zeolite.

8. The process of claim 7 wherein in step (1) the iron group metal in the catalyst is cobalt and the Group VIB metal is molybdenum and in step (2) the iron group metal in the catalyst is nickel and the Group VIB metal is molybdenum.

9. A multi-stage process for demetalation, desulfurization and dewaxing of residual oil which comprises:

(1) contacting a residual oil under demetalation and desulfurization reaction conditions at a temperature of about 500° to about 1000° F., and a pressure of about 300 to about 3000 psig, with a catalyst comprising about 1 to about 10 weight percent of an iron group metal and about 5 to about 25 weight percent of a Group VIB metal, said metals based on the total catalyst, and being present as the oxides or sulfides, on a support comprising at least 85 weight percent alumina, said catalyst having at least 65 percent of its pore volume in the 150 to 300 Angstroms diameter range or at least 60 percent of its pore volume in the 100–200 Angstroms diameter range, (2) contacting the product of step (1), under desulfurization and dewaxing reaction conditions at a temperature of about 500° to about 1000° F., and a pressure of about 300 to about 3000 psig, with a catalyst comprising about 1 to about 10 weight percent of an iron group metal and about 5 to about 25 weight percent of a Group VIB metal, said metals based on the total catalyst, and being present as the oxides or sulfides on a support comprising a composite of alumina and about 5 to about 25 weight percent of a ZSM-5 crystalline zeolite based on the total composite, said catalyst having at least 50% of its pore volume in the 30 to 100 Angstroms diameter range.

10. The process of claim 1 or 9 wherein said iron group metal of the catalyst used in step (1) is nickel.

11. The process of claim 1 or 9 wherein said iron group of the catalyst used in step (2) is cobalt.

12. The process of claim 7 wherein in step (1) the iron group metal in the catalyst is nickel and the Group VIB metal is molybdenum and in step (2) the iron group metal in the catalyst is cobalt and the Group VIB metal is molybdenum.

* * * * *

UNITED STATES PATENT AND TRADEMARK OFFICE

CERTIFICATE OF CORRECTION

PATENT NO. : 4,508,615

DATED : April 2, 1985

INVENTOR(S) : Stephen M. OLECK et al

It is certified that error appears in the above-identified patent and that said Letters Patent is hereby corrected as shown below:

Claims 2, 3, 4, 5, and 6, line 1 of each, after "1" insert --or 9--.

Signed and Sealed this

*Twenty-sixth* Day of *November 1985*

[SEAL]

*Attest:*

DONALD J. QUIGG

*Attesting Officer*

*Commissioner of Patents and Trademarks*